US006696792B1

(12) United States Patent
Foster

(10) Patent No.: US 6,696,792 B1
(45) Date of Patent: Feb. 24, 2004

(54) COMPACT PLASMA ACCELERATOR

(75) Inventor: John E. Foster, Berea, OH (US)

(73) Assignee: The United States of America as represented by the United States National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 10/215,129

(22) Filed: Aug. 8, 2002

(51) Int. Cl.[7] ..... H01J 33/00
(52) U.S. Cl. ..... 315/111.21; 315/111.41
(58) Field of Search ..... 315/111.01–111.91; 118/723 R, 723 ME, 723 MR, 723 MA; 438/738; 60/202, 203.1

(56) References Cited

U.S. PATENT DOCUMENTS

| | | | | |
|---|---|---|---|---|
| 4,937,456 A | * | 6/1990 | Grim et al. | 315/111.41 |
| 5,359,258 A | | 10/1994 | Arkipov et al. | 315/111.41 |
| 5,475,354 A | | 12/1995 | Valentian et al. | 315/111.21 |
| 5,509,266 A | | 4/1996 | Morosov et al. | 60/203.1 |
| 5,523,652 A | * | 6/1996 | Sferlazzo et al. | 315/111.41 |
| 5,581,155 A | | 12/1996 | Morosov et al. | 315/111.21 |
| 5,751,113 A | | 5/1998 | Yashov et al. | 315/111.21 |
| 5,847,493 A | | 12/1998 | Yashov et al. | 313/231.31 |
| 5,892,329 A | | 4/1999 | Arkipov et al. | 315/111.11 |
| 6,031,334 A | | 2/2000 | Meyer | 315/111.01 |
| 6,075,321 A | | 6/2000 | Hruby | 315/111.91 |
| 6,150,764 A | | 11/2000 | Hruby et al. | 315/111.61 |
| 6,200,911 B1 | * | 3/2001 | Narwankar et al. | 438/738 |
| 6,208,080 B1 | | 3/2001 | King et al. | 315/111.41 |
| 6,215,124 B1 | | 4/2001 | King | 250/423 R |
| 6,279,314 B1 | | 8/2001 | Valentian et al. | 60/202 |
| 6,611,106 B2 | * | 8/2003 | Monkhorst et al. | 315/111.41 |

* cited by examiner

*Primary Examiner*—Wilson Lee
(74) *Attorney, Agent, or Firm*—Kent N. Stone; Howard M. Cohn

(57) ABSTRACT

A compact plasma accelerator having components including a cathode electron source, an anodic ionizing gas source, and a magnetic field that is cusped. The components are held by an electrically insulating body having a central axis, a top axial end, and a bottom axial end. The cusped magnetic field is formed by a cylindrical magnet having an axis of rotation that is the same as the axis of rotation of the insulating body, and magnetized with opposite poles at its two axial ends; and an annular magnet coaxially surrounding the cylindrical magnet, magnetized with opposite poles at its two axial ends such that a top axial end has a magnetic polarity that is opposite to the magnetic polarity of a top axial end of the cylindrical magnet. The ionizing gas source is a tubular plenum that has been curved into a substantially annular shape, positioned above the top axial end of the annular magnet such that the plenum is centered in a ring-shaped cusp of the magnetic field generated by the magnets. The plenum has one or more capillary-like orifices spaced around its top such that an ionizing gas supplied through the plenum is sprayed through the one or more orifices. The plenum is electrically conductive and is positively charged relative to the cathode electron source such that the plenum functions as the anode; and the cathode is positioned above and radially outward relative to the plenum.

14 Claims, 4 Drawing Sheets

COMPACT PLASMA ACCELERATOR

ORIGIN OF THE INVENTION

The invention described herein was made by an employee of the United States Government and may be manufactured and used by or for the Government for Government purposes without the payment of any royalties thereon or therefor.

TECHNICAL FIELD OF THE INVENTION

The present invention relates to a plasma generator and accelerator and, more particularly to a low power, compact plasma accelerator that can be used for satellite propulsion, drag reduction and station-keeping, or for ion plasma material processing in a vacuum.

BACKGROUND OF THE INVENTION

There is a need for a simple, low power, light-weight, compact, high specific impulse electric propulsion device to satisfy mission requirements for micro and nano-satellite class missions. Satisfying these requirements entails addressing the general problem of generating a sufficiently dense plasma within a relatively small volume and then accelerating it in a way that generates a net thrust reaction force in a desired linear direction. Known means for ion generation and propulsion generally require relatively large containment volumes in order to achieve reasonable ionization efficiencies, therefore new means are needed in order to achieve effective scaled-down propulsion devices.

Recent prior art electric propulsion devices and plasma accelerators are commonly some form of Hall effect thrusters (Hall accelerators or Hall engines). A conventional Hall effect thruster generally comprises an accelerating channel arranged along an axis with an anode and a propellant source at a first, generally closed, end of the channel, and a cathode (electron source) at a second, generally open, end of the channel. The cathode and anode establish an electric field with a gradient generally aligned with the axis of the channel. A system of magnets is arranged so that a magnetic field crosses the channel.

To continue the description of the Hall effect thruster, an exemplary thruster is presented comprising an annular accelerating channel extending circumferentially around the axis of the thruster and also extending in an axial direction from a closed end to an open end. The anode is usually located at the closed end of the channel, and the cathode is positioned outside the channel close to its open end. Means is provided for introducing a propellant, for example xenon gas, into the channel and this is often done through passages formed in the anode itself or close to the anode. A magnetic system applies a magnetic field in the radial direction across the channel and this causes electrons emitted from the cathode to move circumferentially around the channel. Some but not all of the electrons emitted from the cathode pass into the channel and are attracted down the electric field gradient towards the anode. The radial magnetic field deflects the electrons in a circumferential direction so that they move in a spiral trajectory, accumulating energy as they gradually drift towards the anode. In a region close to the anode the electrons, collide with atoms of the propellant, causing ionization. The resulting positively charged ions are accelerated by the electric field towards the open end of the channel, from which they are expelled at great velocity, thereby producing the desired thrust. Because the ions have a much greater mass than the electrons, they are not so readily influenced by the magnetic field and their direction of acceleration is therefore primarily axial rather than circumferential with respect to the channel. The ion stream is at least partially neutralized by those electrons from the cathode that do not pass into the channel.

Conventionally, the required radial magnetic field has been applied across the channel using an electromagnet having a yoke of magnetic material which defines poles on opposite sides of the channel, i.e. one radially inwardly with respect to the channel and the other radially outwardly with respect to the channel. An example is shown in European patent specification 0 463 408 which shows a magnetic yoke having a single cylindrical portion passing through the middle of the annular channel and carrying a single magnetizing coil; and a number of outer cylindrical members spaced around the outside of the accelerating channel and carrying their own outer coils. The inner and outer cylindrical members are bolted to a magnetic back plate so as to form a single magnetic yoke.

A recent example of the Hall effect thruster is disclosed in U.S. Pat. No. 5,847,493 (Yashnov, et al.; 1998) entitled "Hall Effect Plasma Accelerator". The described invention in the U.S. Pat. No. 5,847,493 Patent comprises the use of magnets (permanent or preferably electric) wherein the magnetic poles are defined on bodies of material which are magnetically separate in order to allow greater freedom in selecting the dimensions of the thruster, particularly the length in the axial direction relative to the diameter of the accelerating channel.

U.S. Pat. No. 5,751,113 (Yashnov, et al.; 1998), discloses a closed electron drift Hall effect plasma accelerator with all magnetic sources located to the rear of the anode. It is stated that this makes it possible to provide a Hall effect accelerator with an optimum distribution of magnetic field inside the acceleration channel by means of a simpler and less heavy arrangement using a single source of magnetic field, such as a single coil or permanent magnet. As in all Hall effect thrusters, the magnetic field lines (13, as seen in FIG. 2) extend laterally across the accelerating channel (1) over the anode (2) and propellant gas source (3) located at the closed end of the channel (see FIG. 1).

A problem common to the Hall effect thrusters is one of scaling its size. In general, it is difficult to scale down Hall effect thrusters appreciably because of the magnetic field requirements. In smaller engines, the large transverse magnetic fields required can hamper ion flow, thereby reducing the ion beam current. This is particularly problematic for such engines generating milliamp magnitude beams for micro-thruster applications, wherein small thrust to power ratios make Hall effect thrusters impractical for micro-satellite applications. Another scaling problem is that electromagnets do not scale well with size reduction because of heating issues and coil size required to achieve the desired field.

Hall effect thrusters generally employ hollow cathodes, and preferably employ electromagnets, thereby requiring fairly complicated, and thus heavier, control systems in order to control electromagnet current, gas flow in both the anode and the discharge electrode, and cathode discharge current. Adding to the problems of complexity and weight, the hollow cathode consumes propellant.

U.S. Pat. No. 6,075,321 (Hruby; 2000), discloses a Hall field plasma accelerator with an inner and outer anode, designed to deal with problems of wall heating and sputtering that are characteristic problems with Hall effect thrusters.

A non-Hall effect thruster is described by U.S. Pat. No. 4,937,456 (Grim, et al.; 1990), that discloses a dielectric coated ion thruster comprising a cathode chamber (12) from which free electrons flow into an attached ionization chamber (14) along with a flow of ionizable gas atoms. According to the abstract and to column 6 of the detailed description, the free electrons are accelerated by a positive potential applied to the interior surface of the ionization chamber, causing the electrons to collide with atoms of the gas with sufficient kinetic energy to create ions. The positively charged ions are accelerated toward a negatively charged perforated grid plate (24, 112), pass through the grid plate, and exit in a focused beam, providing thrust in the opposite direction. A plurality of bar magnets (20, 22, 108, 110) are arranged in a spaced apart circular array around the cathode chamber with a pole face of each of the magnets tangentially aligned with wall sections (16, 18, 102, 104) of the ionization chamber. The bar magnets define an axial geodesic picket fence arrangement that extends circularly about the cathode chamber, wherein the pole faces of adjacent bar magnets that are in contact with the ionization chamber alternate north and south polarity, so that a magnetic field extends between the opposite pole faces of adjacent bar magnets. Although magnetic field lines are not illustrated, it can be seen from FIGS. 1 and 5, for example, that the magnetic field lines will arch from pole to pole to create a scalloped line around the circumference of the ionization chamber with cusps occurring at each pole. As stated in column 7 of the detailed description, as a negatively charged electron is accelerated toward the wall sections, the magnetic field interacts with the moving charge, causing the electron to experience a force directed generally at a right angle to its forward velocity. In response to this force, the electrons are caused to spiral in a helical path, thereby extending the mean path of the electrons to increase the probability that the electrons may strike an atom and ionize it. Since the magnetic field lines that confine the plasma within the ionization chamber bend laterally away from the magnet poles (forming cusps), the surfaces of the poles are not well protected by the magnetic field and would normally be exposed to erosion due to impacts by high-energy electrons or ions, therefore dielectric coating (42) is provided to protect them from sputtering. Likewise, the outer surface of an emitter tube (28, 61, 128), and the inner and outer surfaces of the grid plate, are coated with a dielectric material to protect them from sputtering erosion.

Problems inherent in conventional ion thrusters with grids (e.g., U.S. Pat. No. 4,937,456) include significant erosion issues for which dielectric coatings are needed to help provide protection, thereby adding weight and complexity. Furthermore, the use of grids along with charged chamber walls require the use of multiple power supplies, thereby complicating the power processor unit. Finally, gridded systems have inherently lower thrust density capability relative to gridless concepts.

It is known that plasma accelerators can be used for material processing in a vacuum by means of plasma ion interaction with materials. U.S. Pat. No. 6,380,684 (Li, et al.; 2002) discloses a plasma generating apparatus and semiconductor manufacturing method which generates a high-density plasma in a rectangular chamber using magnetron, high frequency discharge plasma generation, i.e., a high frequency oscillating electric field that interacts with magnetic fields to produce electrons and ions in a plasma. An annular-rectangular ("fistulous") discharge electrode (14) is in close proximity to concentric annular-rectangular permanent magnets (15, 16) that are arranged axially on either side of the discharge electrode to generate magnetic field lines that loop over the discharge electrode to cusps that are on either axial side of the electrode. Rectangular parallel plate electrodes (17, 18) at the top and bottom of the chamber are either grounded or connected to a second high frequency source. The top electrode 17 is used, for example, as gas diffusion plate for diffusing a discharge gas or a process gas, wherein the top electrode (17) is a perforated gas shower plate (37).

It is an object of the present invention to provide a compact plasma accelerator that overcomes problems such as those described hereinabove for known devices, thereby providing sufficient thrust density to provide a simple, low power, light-weight, compact, high specific impulse electric propulsion device to satisfy mission requirements for micro and nano-satellite class missions.

BRIEF SUMMARY OF THE INVENTION

According to the invention, a compact plasma accelerator has components including a cathode electron source, an anode, a source of ionized gas, and a magnetic field source, wherein: the components are held by an electrically insulating body having a central axis, a top axial end, and a bottom axial end The magnetic field source comprises: a cylindrical magnet having an axis of rotation that is the same as the axis of rotation of the insulating body, and magnetized with opposite poles at its two axial ends; and an annular magnet coaxially surrounding the cylindrical magnet, magnetized with opposite poles at its two axial ends such that a top axial end has a magnetic polarity that is opposite to the magnetic polarity of a top axial end of the cylindrical magnet. The source of ionized gas is a tubular plenum that has been curved into a substantially annular shape, positioned above the top axial end of the annular magnet such that the plenum is centered in a ring-shaped cusp of a magnetic field generated by the magnetic field source, and having one or more capillary-like orifices spaced around the top of the plenum such that an ionizing gas supplied through the plenum is sprayed through the one or more orifices. The plenum is electrically conductive and is positively charged relative to the cathode electron source such that the plenum functions as the anode; and the cathode electron source is positioned above and radially outward relative to the plenum.

According to the invention, the compact plasma accelerator is further characterized in that the cylindrical magnet and the annular magnet are preferably permanent magnets.

According to the invention, the compact plasma accelerator is further characterized in that the plenum is preferably enclosed in an electrically insulating material having an axially-oriented hole above each of the one or more orifices. Furthermore, the body preferably has a cavity opening upward and sized to enclose the plenum in combination with an electrically insulating cover plate that covers the cavity and the plenum, and the cover plate has the axially-oriented holes.

According to the invention, the compact plasma accelerator is preferably further characterized in that a field shaping plug is mounted in the insulating body above the cylindrical magnet such that the field shaping plug's axis of rotation is the same as the axis of rotation of the cylindrical magnet, the field shaping plug is a cylinder that comes to a conical point at its top axial end, and is made of a ferromagnetic material; such that the field shaping plug concentrates the magnetic field emerging from the top axial end of the cylindrical magnet to form a very narrow pointed cusp above the field shaping plug. Furthermore, the field shaping plug is preferably made of mild steel.

According to the invention, the compact plasma accelerator is preferably further characterized in that the bottom axial end of the insulating body is covered by a backing plate made of a ferromagnetic material such that the backing plate concentrates the magnetic field at the bottom axial end of the cylindrical magnet and the annular magnet. Furthermore, the backing plate is preferably made of mild steel.

According to the invention, the compact plasma accelerator is further characterized in that the cathode electron source is preferably a hot filament, a field emitter type cathode or a very low flow rate hollow cathode type device. Furthermore, the hot filament cathode electron source preferably comprises one or more wires shaped in a ring that circumnavigates the plenum above and radially outward relative to the plenum. Also, preferably a single power source powers the hot filament cathode electron source and also the positively charged, anodic, plenum. It is within the terms of the invention to use a separate power source to power the filament supply.

According to the invention, the compact plasma accelerator is, further characterized in that the cathode electron source may be one or more hollow cathodes. According to the invention, the compact plasma accelerator is further characterized in that the electrically insulating body is preferably made using a ceramic material. Furthermore, the ceramic material is preferably a machinable ceramic.

According to the invention, a method of producing and accelerating an ion beam comprises the steps of:

a) providing a magnetic field with a cusp that opens in an outward direction along a centerline that passes through a vertex of the cusp;

b) providing an ionizing gas that sprays outward through at least one capillary-like orifice in a plenum that is positioned such that the orifice is on the centerline in the cusp, outward of the vertex of the cusp;

c) providing a cathode electron source, and positioning it outward of the orifice and off of the centerline; and d) positively charging the plenum relative to the cathode electron source such that the plenum functions as an anode.

According to the invention, the method of producing ,and accelerating an ion beam preferably further comprises the steps of:

e) using a hot filament for the cathode electron source; and f) powering both the hot filament cathode electron source and the positively charged, anodic, plenum with a one or more power sources According to the invention, the method of producing and accelerating an ion beam preferably further comprises the steps of:

g) using a hot filament for the cathode electron source; and h) powering both the hot filament cathode electron source and the positively charged, anodic, plenum with one or more power sources.

According to the invention, the method of producing and accelerating an ion beam preferably further comprises the step of using permanent magnets for providing the magnetic field.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes.

For example, 109, 109', and 109" are three different elements which are similar or related in some way, but have significant modifications, e.g., a tire 109 having a static imbalance versus a different tire 109' of the same design, but having a couple imbalance. Such relationships, if any, between similar elements in the same or different figures will become apparent throughout the specification, including, if applicable, in the claims and abstract.

Figure 1:
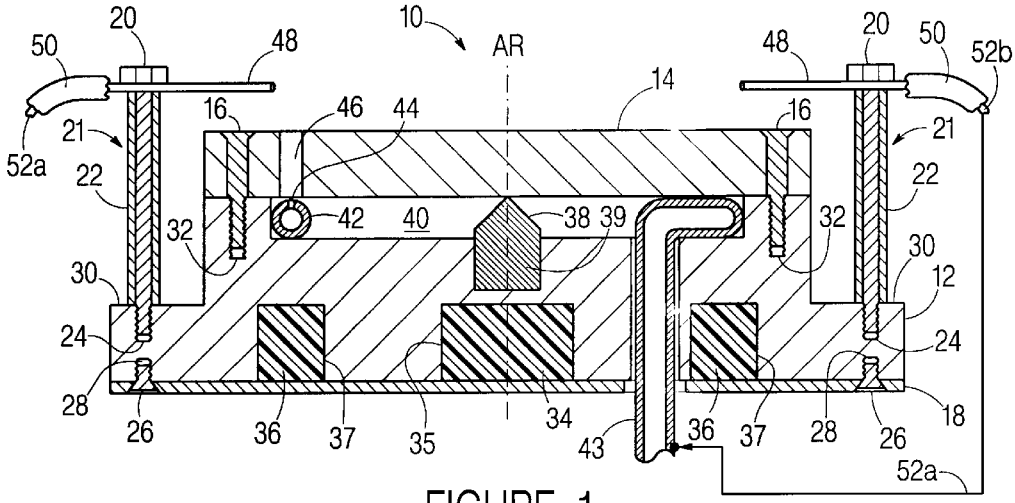
Figure 2:
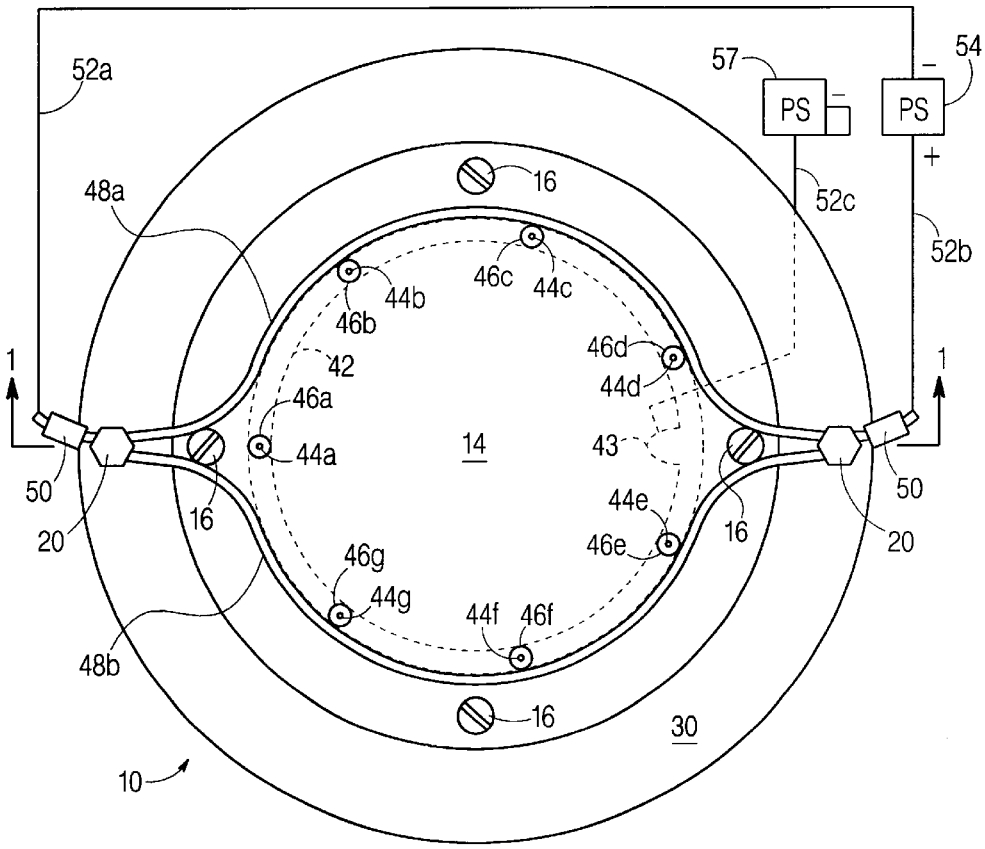
Figure 3:
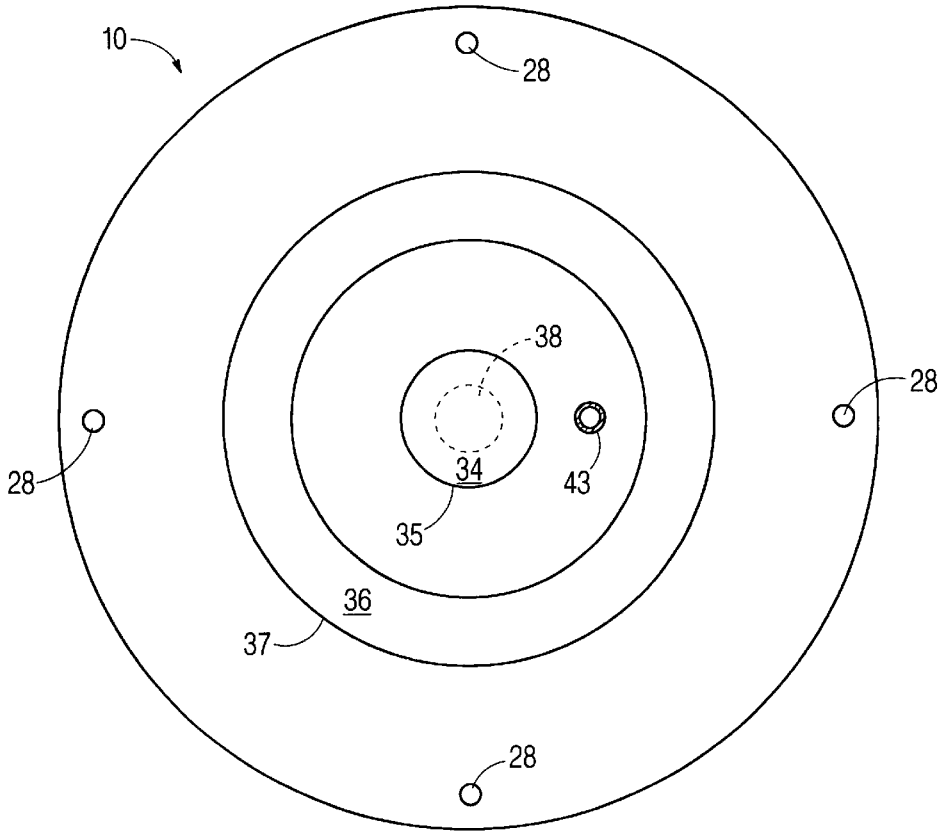
Figure 4:
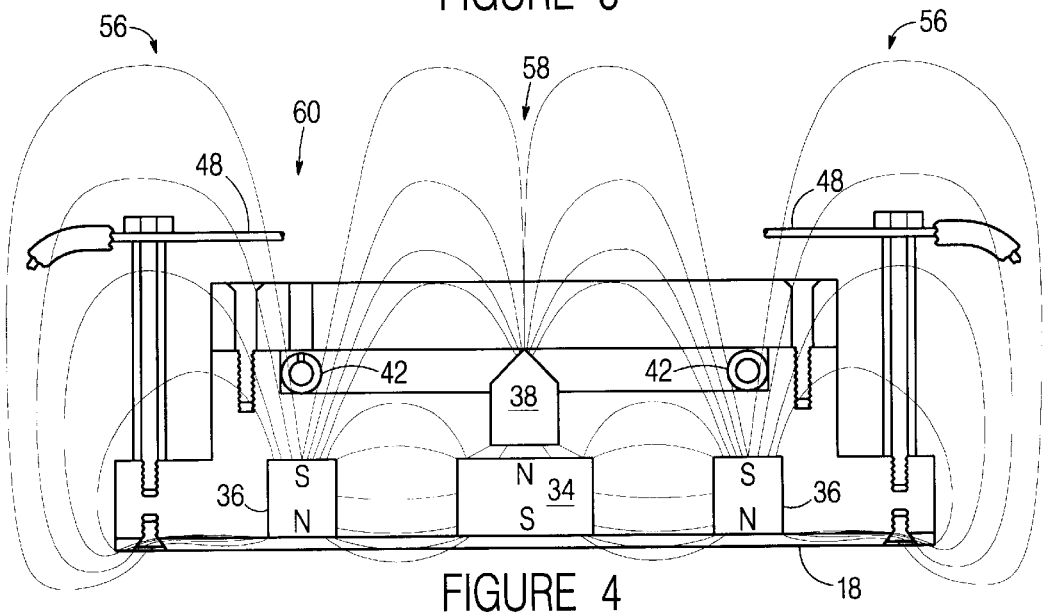
Figure 5:
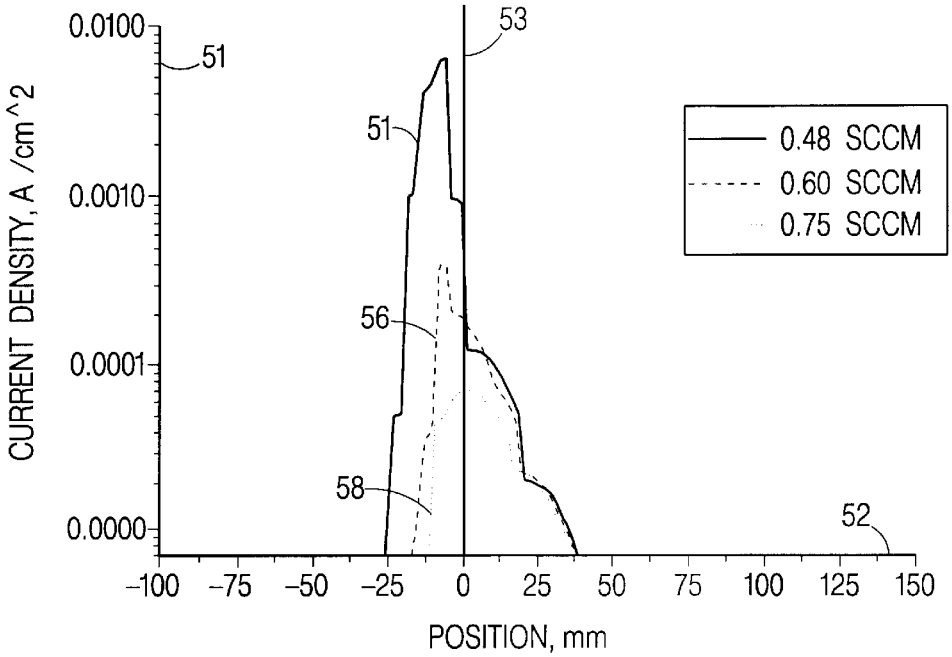
Figure 6:
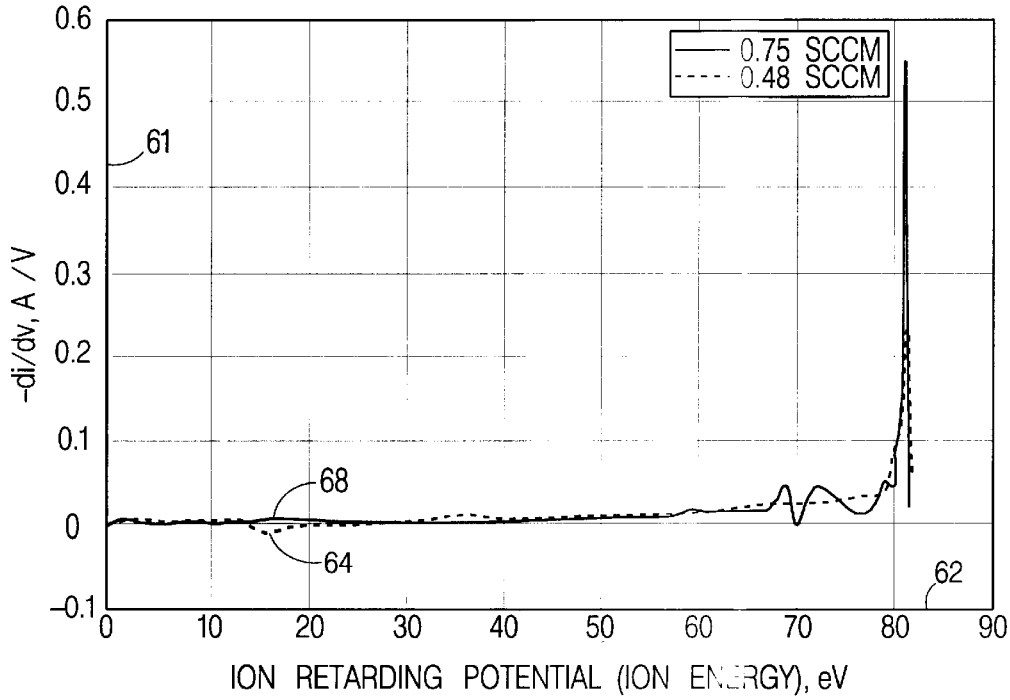
Figure 7:
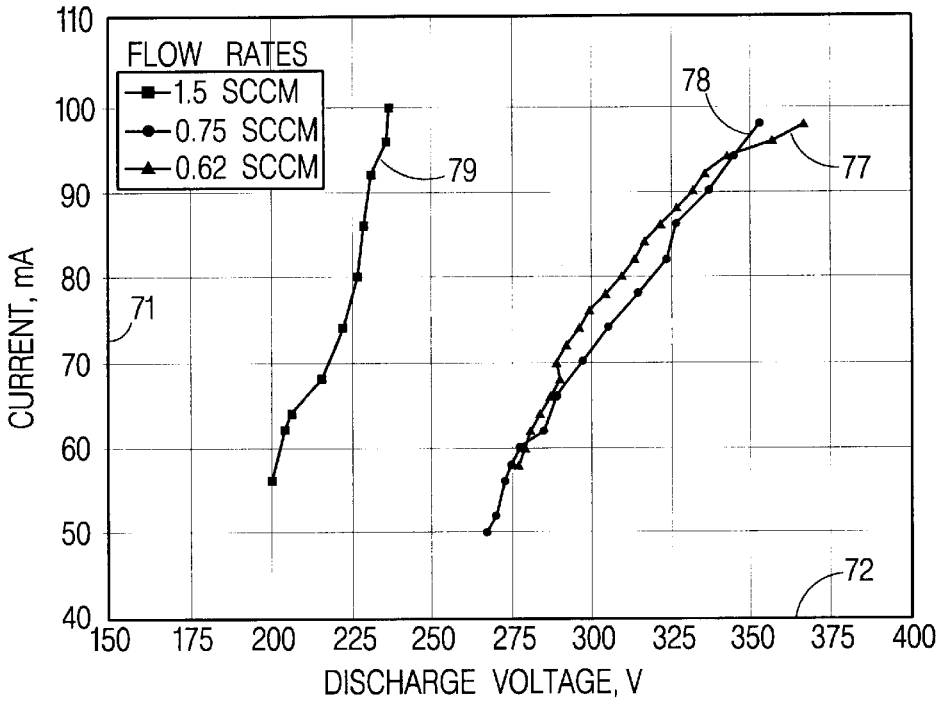
Figure 8:
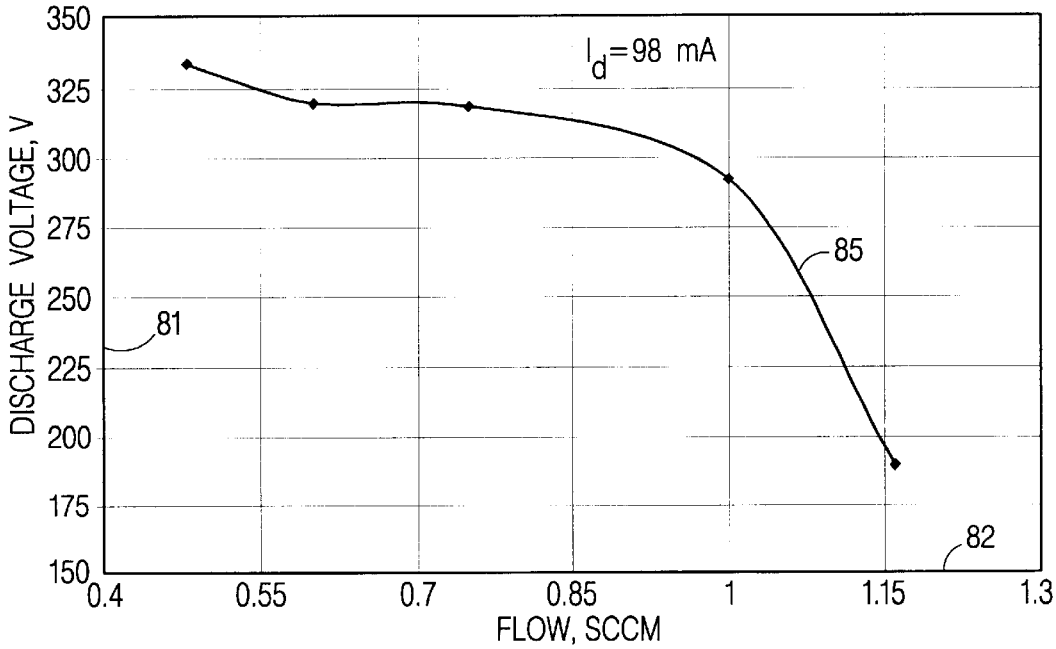

The structure, operation, and advantages of the present preferred embodiment of the invention will become further apparent upon consideration of the following description taken in conjunction with the accompanying drawings, wherein:

FIG. 1 is a side cross-sectional view, taken on a line 1—1 seen in FIG. 2, of an embodiment of the compact plasma accelerator according to the invention;

FIG. 2 is a top view of an embodiment of the compact plasma accelerator, with a hidden plenum shown by dashed lines, and with electrical circuitry shown schematically, according to the invention;

FIG. 3 is a bottom view of an embodiment of the compact plasma accelerator, with a hidden field shaping plug shown by dashed lines, and with electrical circuitry and a backing plate omitted for clarity, according to the invention;

FIG. 4 is the side cross-sectional view of FIG. 1, showing magnetic field lines, and omitting cross-sectional shading, a plenum supply line, and external circuitry for the sake of clearly showing the magnetic field lines, according to the invention;

FIG. 5 is a plot of downstream ion beam current density versus radial position, at several propellant flow rates, according to the invention;

FIG. 6 is a plot of downstream ion beam energy distributions, at several propellant flow rates, according to the invention;

FIG. 7 is a plot of discharge current versus discharge voltage, at several propellant flow rates, according to the invention; and FIG. 8 is a plot of discharge voltage versus propellant flow rate (note plot is of discharge voltage vs. flow rate, not beam current) when the discharge current is held constant at 98 milliamps, according to the invention.

DETAILED DESCRIPTION OF THE INVENTION

The present invention is directed toward satisfying a need for a low power, light-weight (compact), high specific impulse electric propulsion device to satisfy mission requirements for micro and nano-satellite class missions. Satisfying these requirements entails addressing the general problem of generating a sufficiently dense plasma within a relatively small volume and then accelerating it. Such a plasma source utilizing a magnetic cusp to generate a dense plasma over small length scales has been built and tested. This approach could potentially mitigate the need for large containment volumes (size) in order to achieve reasonable ionization efficiencies. The discharge plasma is both generated and accelerated via this approach using in principle only a single power supply. Data suggests that the invention should be capable of generating between 0.5 and 1.0 mN (milli-Newton) of thrust. Applications envisioned include low energy plasma processing in addition to propulsion for satellite station-keeping, drag reduction and primary propulsion for micro-satellites. The invention will be described in the form of its preferred embodiment as a compact plasma accelerator.

In its preferred embodiment, the invention employs a magnetic cusp to effectively utilize discharge electrons for ionization purposes and at the same time to generate sufficiently high sheath potentials for accelerating ions outward to develop thrust. This approach utilizes a single electron source that provides not only discharge electrons but also electrons to neutralize the ion beam exiting the device. Because this approach is gridless, it can develop higher thrust densities than a gridded ion source of similar dimensions. Additionally, because the device operates on inert gases, the plume is non-contaminating to space craft surfaces. This point is to be contrasted with other options such as PPT (pulsed plasma thruster) and FEEP (field enhanced electric propulsion) systems which generate contaminating and often toxic plumes.

A preferred embodiment of the inventive accelerator is illustrated in several views in FIGS. 1–3, FIG. 1 being a cross-sectional side view with the cross-section taken along the line 1—1 as indicated in the top view of FIG. 2. FIG. 3 is a bottom view wherein a bottom plate has been removed to allow a view of internal elements. For convenience in this description, the terms "top" and "bottom" will be used to indicate directions as they are illustrated in the side view of FIG. 1. Of course these directions are not intended to be limiting, but rather are used to indicate relative positioning of various components. As is known in the relevant arts, plasma accelerators will function in any orientation relative to a gravitational field.

With reference to FIGS. 1–3, the preferred embodiment of the invention is a compact plasma accelerator (thruster) 10 having major components that include a cathode electron source, an anode, an ionizing gas source (also referred to as a source of ionized gas), and a magnetic field source. The components are held by a disc-shaped electrically insulating body 12, preferably made of ceramic, e.g., a machinable ceramic such as Macor™. The top of the body 12 has a matching circular cover plate 14, also electrically insulating and preferably made of ceramic, e.g., Macor™, held in place by screws 16 that are recessed into the cover plate 14 enough to be at least flush with the top surface of the cover plate 14. A minimum number of screws 16 are utilized, for example four screws 16 spaced evenly around the perimeter of the cover plate 14 may be adequate to secure the cover plate 14 on top of the body 12. The screws 16 are made of a nonmagnetic material (e.g., stainless steel), and threaded holes 32 can be provided in the body 12 by known means. The bottom of the body 12 has a matching circular backing plate 18 made of a ferromagnetic material (e.g., mild steel) held in place by screws 26 that are recessed into the backing plate 18 enough to be at least flush with the bottom surface of the backing plate 18. A minimum number of screws 26 are utilized, for example four screws 26 spaced evenly around the perimeter of the backing plate 18 may be adequate to secure the backing plate 18 onto the body 12. The screws 26 are made of a nonmagnetic material (e.g., stainless steel), and threaded holes 28 can be provided in the body 12 by known means.

The body 12 has an annular stepped-down portion 30 surrounding the periphery of the top of the body 12. Mounted on the stepped-down portion 30 are at least two standoffs 21 for holding cathodes 48*a*, 48*b* (collectively referred to as 48), the standoffs 21 comprising bolts 20, made of a nonmagnetic material, passing through insulating (e.g., ceramic) standoff sleeves 22, and screwed into threaded holes 24 provided in the stepped-down portion 30 of the body 12. In the preferred embodiment, the cathode 48 is a hot filament cathode (e.g., double-braided tantalum wire coated with barium carbonate, R-500 compound) that is supported by the standoffs 21 and circumnavigates the cover plate 14 in two portions 48*a*, 48*b* that are collectively referred to as cathode 48. The circumnavigating cathode 48 is positioned above and radially outward relative to holes 46 that are spaced around the cover plate 14, and more fully described hereinbelow. As illustrated in FIG. 2 for the preferred embodiment, the inner diameter of the circumnavigating cathode 48 is located along the edge of the circle defined by the radially outermost edges of the holes 46. Current for the hot filament cathode 48 is provided by a power supply 54 that, for example, passes current through supply wire 52*a*, through cathode wires 48*a*, 48*b*, and back to the power supply 54 through supply wire 52*b*. The supply wires 52*a*, 52*b* are covered with insulating sleeves 50 (e.g., woven fiberglass sleeves). A discharge power supply 57 provides power to a plenum supply line 43 through a supply wire 52*c*. The current for the discharge plenum supply line passes from the discharge power supply 57 through supply wire 52*c*, and charges the plenum anode positively. Then, the electrons leave the negative end of the discharge power supply 57 and enter the vacuum. The electrons collect at the anode and return to the discharge power supply 57 through wire 52*c*. The supply wires 52*a*, 52*b*, 52*c*, 52*d* are covered with insulating sleeves 50 (e.g., woven fiberglass sleeves). Alternatively, other electron sources could be utilized for the cathodes 48 such as, for example, one or more hollow cathodes or field emission type cathodes, however hot filament cathodes 48 are preferred because, among other reasons, they function with a single simple power supply, and do not require a gas supply and are less sensitive to poisoning issues.

The magnetic field source comprises two magnets, preferably permanent to avoid the complication of added power supplies needed to power electromagnets. A cylindrical magnet 34 is mounted in a matching recess 35 of the body 12 such that the axis of rotation AR of the cylindrical magnet 34 is the same as the axis of rotation AR of the insulating body 12. The cylindrical magnet 34 is magnetized with opposite poles at its two axial ends. An annular magnet 36 coaxially surrounds the cylindrical magnet 34, and is magnetized with opposite poles at its two axial ends such that a top axial end has a magnetic polarity that is opposite to the magnetic polarity of a top axial end of the cylindrical magnet 34. For example, as shown in FIG. 4, the top axial end of the cylindrical magnet 34 is a "north" (N) pole and the bottom axial end of the cylindrical magnet 34 is a "south" (S) pole; whereas the top axial end of the annular magnet 36 is a "south" (S) pole and the bottom axial end of the annular magnet 36 is a "north" (N) pole.

A magnetic field 56 is indicated by magnetic field lines in FIG. 4. In order to clearly see the magnetic field lines, cross-section shading has been omitted from the cross-sectional side view of FIG. 4. The shape of the magnetic field is influenced by two elements: a field shaping plug 38 and the backing plate 18. The backing plate 18 (made of a ferromagnetic material, e.g., 1020 steel, i.e., mild steel) not only helps to physically hold the magnets 34, 36 in their respective recesses 35, 37, but also concentrates the magnetic field 56 as shown on the bottom axial end of the magnets 34, 36. The field shaping plug 38 is a cylinder that comes to a conical point at its top axial end, and is also made of a ferromagnetic material, e.g., 1020 steel. Referring also to FIG. 3, the field shaping plug 38 is mounted in a matching recess 39 of the body 12 such that its axis of rotation AR is the same as the axis of rotation AR of the insulating body 12 and of the cylindrical magnet 34. The field shaping plug 38 concentrates the magnetic field lines 56 emerging from the top axial end of the cylindrical magnet 34 to form a very narrow pointed cusp 58 above the field shaping plug 38. An important feature of the present invention, however, is a second, ring-shaped cusp 60 formed in the magnetic field 56 above the annular magnet 36.

Referring to FIGS. 1 and 2, the ionizing gas source is a tubular plenum 42 that has been curved into a substantially annular shape, and mounted in a cavity 40 in the top of the body 12. The plenum 42 is seen in top view in FIG. 2, but is shown in dashed lines because it is hidden beneath the cover plate 14. The plenum 42 is positioned above the top axial end of the annular magnet 36 such that the plenum is centered in the ring-shaped magnetic cusp 60. The plenum 42 has one or more capillary-like orifices (e.g., seven orifices 44*a*, 44*b*, 44*c*, 44*d*, 44*e*, 44*f*, 44*g* collectively referred to as 44) spaced around the top of the plenum 42 such that an ionizing gas (propellant, e.g., Xenon) supplied through the plenum 42 is sprayed through the orifices 44. The orifices 44 are capillary-like openings so that even at low flow rates, the pressure in the orifices 44 is sufficiently high (e.g., a few Torr) such that the diameter of an orifice 44 is of the order of an electron-neutral mean free path. The cover plate 14 has holes (e.g., seven holes 46*a*, 46*b*, 46*c*, 46*d*, 46*e*, 46*f*, 46*g* collectively referred to as 46) wherein each hole 46 is centered over a corresponding orifice 44 in the plenum 42. The cover plate holes 46 are much larger in diameter than the plenum orifices 44 (e.g., 20 times larger in diameter), thereby allowing substantially unobstructed passage of electrons and ions. The main purpose of the cover plate 14 and the cover plate holes 46 is to limit access of electrons from the cathode 48 such that the electrons are able to reach the plenum 42 mainly in the vicinity of the orifices 44. The ionizing gas is supplied to the plenum 42 via a plenum supply line 43 that passes through a conveniently located hole in the body 12. If passing through the metal backing plate 18 as shown in FIG. 1, then an oversize hole in the backing plate 18 is preferably provided to avoid electrical contact between the backing plate 18 and the plenum supply line 43. The plenum 42 is electrically conductive, but nonmagnetic (e.g., stainless steel), and is positively charged to function as an anode. It can be seen that it is possible to use the single power supply 54 to positively charge the plenum 42 (e.g., by means of a connecting wire 52*c*) in addition to powering the hot filament cathode 48. The negatively charged hot filament cathode 48 electron source is positioned above and radially outward relative to the plenum 42 and relative to the holes 46 in the cover plate 14, the positioning being such that electrons emitted from the cathode 48 must undergo cross-magnetic-field 56 diffusion to reach the anode/plenum 42 through the cover plate holes 46.

OPERATION OF THE COMPACT PLASMA ACCELERATOR

An electric field (not illustrated) is established with a gradient from the negatively charged cathode (hot filament cathode 48) to the positively charged anode (plenum 42). The hot filament cathode 48 emits electrons. As described hereinabove, the cathode 48 is located such that emitted electrons must undergo cross-field diffusion to reach the anode 42. Under these conditions, electron diffusion is severely restricted. Due to interaction with the magnetic field 56, electrons will either directly follow the magnetic field lines 56 or spiral about them. Any electrons having a velocity component directed downward toward the anode will therefore be funneled by the ring-shaped cusp 60 toward the plenum 42. The electric field gradient establishes conditions that cause a majority of the emitted electrons to be attracted down the gradient toward the anode/plenum 42. The electrically insulating cover plate 14 with holes 46 above the plenum orifices 44 restrict the possible electron paths such that the electrons are funneled to the plenum 42 in the vicinity of the plenum orifices 44. The electrons ionize propellant (the ionizing gas) in the plenum orifices 44. Each orifice 44 serves as an independent discharge cell that provides copious amounts of ions that are subsequently accelerated upward by sheath potentials, i.e., the ions (positively charged) are electrically repelled away from the positively charged plenum 42, thereby providing thrust force that is proportional to the ion beam current and its exhaust velocity.

Transverse magnetic field components tend to increase the cathode fall voltage. The increase in the cathode fall voltage is necessary to produce energetic electrons for ionization inside the plenum orifices 44. The maximum electron-neutral ionization cross section for xenon occurs around 150 eV (electron volts). Cathode fall voltages of this order maximize ionization efficiency. Energetic electrons with a sufficient velocity component parallel to the magnetic field 56 enter the orifice 44 to participate in the ionization process. Those without sufficient parallel velocities are reflected by a mirror force. Because the electrons reflected by the mirror force are constrained by the magnetic field lines 56, the reflected electrons will oscillate between the cathode 48 (negatively charged and therefore repellent to electrons) and the mirror force at the plenum 42. The likelihood that these electrons ionize a neutral ionizing gas molecule in the vicinity of the plenum 42 increases as energetic electrons bounce between the cathode 48 and the plenum 42. This bouncing motion enhances the primary electron containment length.

Ions formed in the plenum orifice 44 are accelerated by the electric field potential gradient across the sheath at the plenum 42. The magnitude of the voltage drop at the anode/plenum 42 is likely to be a strong function of the transverse magnetic field component there. The ions emitted from the sheath at the anode/plenum 42 form an axially directed beam. The ring-shaped cusp 60 helps to focus the ion beam, and divergence of the ion beam is reduced by the neutralizing effect of electrons emitted into the beam by the cathode 48. In this respect the cathode 48 not only provides the ionizing electrons but also the neutralizing electrons, and both actions are enhanced by the ring-shaped cusp 60 of the magnetic field 56 which causes an increased residence time of electrons in the path of the beam, as the electrons spiral about the magnetic field lines 56 and also bounce back and forth between the cathode 48 and anode 42.

Operational Test Results

An embodiment of the invention 10 was built as described hereinabove and tested using Xenon as the ionizing gas (propellant). Some of the test results are charted in FIGS. 5–8.

FIG. 5 is a plot of downstream ion beamlet current density (amps per square centimeter for a single beamlet emanating from one of the orifices 44) indicated on a logarithmic vertical axis 51 versus radial position in the beamlet indicated on a linear horizontal axis 52, measured in millimeters from the estimated center of the orifice 44*b* that created the beamlet. Three curves 54, 56, 58 are shown to illustrate the results at propellant flow rates of 0.48, 0.60, and 0.75 SCCM (standard cubic centimeters per minute), respectively. An estimated radial position of the center of the orifice 44*b* is indicated by the line 53. It can be seen that the peak current density increases significantly as the flow rate is reduced. Also, beam dispersion appears to reduce somewhat as the flow rate is reduced. The following table indicates ion beam current parameter upper limits as estimated from test results. The "utilization" is an efficacy measurement representing the ion current obtained per unit flow of propellant gas molecules, i.e., utilization is a measure of the fraction of input ionizing gas that is converted into ions in the ion beam.

| Flow Rate (SCCM) | Ion Current-One Orifice (milliamps) | Ion Current-Four Orifices (milliamps) | Utilization (equivalent amps) |
|---|---|---|---|
| 0.48 | 7.5 | 30. | 0.88 |
| 0.60 | 1.3 | 5.2 | 0.12 |
| 0.75 | 0.6 | 2.4 | 0.05 |

The tested compact plasma accelerator (thruster) 10 generated a monoenergetic ion beam up to 80 eV. The measured peak current densities are relatively high for such a small device.

FIG. 6 shows ion beam energy distributions as measured at two different propellant flow rates. The term–di/dv, measured in amps per volt, is indicated on a vertical axis 61 and plotted versus ion beam energy (equivalent to ion retarding potential in electron volts (eV) indicated on a horizontal axis 62. The term di/dv is the derivative of the retarding potential analyzer current with respect to voltage, and is proportional to the ion energy distribution function, thereby giving the form/shape of the distribution function with energy. Two curves 64, 68 are shown to illustrate the results at propellant flow rates of 0.48, and 0.75 SCCM, respectively. It can be seen from the spikes in the curves 64, 68 that the ion beam energy dispersion is very small, i.e., the beam is substantially mono-energetic. This is a particularly attractive feature for both propulsion applications (well defined thrust) and thin film processing (incident energy for surface modification or film growth is well defined).

The following table indicates other thruster 10 performance parameters related to propellant flow rates (mass flow rates). The results are from tests conducted on a laboratory prototype thruster 10. Even better results are anticipated for thrusters 10 that have been fully optimized. Measured thrust force (in units of milli-Newtons, niN) is shown for two levels of flow rate. Specific impulse (Isp), having dimensions of seconds (s), represents thrust obtained per unit of mass ejected per second. Specific impulse is defined as the thrust (force in Newtons) obtained from each unit mass of propellant per unit time (thrust divided by mass flow rate).

| Flow Rate (SCCM) | Thrust (mN) | Specific Impulse (s) |
|---|---|---|
| 0.48 | 0.44 | 990 |
| 0.60 | 0.08 | 130 |

It can be seen that the compact plasma accelerator 10 works best at very low flow rates, probably because the ionization efficiency goes down with increasing flow rate.

FIG. 7 is a plot of discharge current (milliamps) indicated on a vertical axis 71, versus cathode-to-anode voltage drop (volts), also known as discharge voltage, indicated on a horizontal axis 72. Three curves 77, 78, 79 are shown to illustrate the results at propellant flow rates of 0.62, 0.75, and 1.5 SCCM, respectively.

FIG. 8 is a plot of discharge voltage (volts) indicated on a vertical axis 81, versus propellant flow rates (SCCM) indicated on a horizontal axis 82. One curve 85 is shown, measured under a condition of constant discharge current ($I_d$), i.e., at each propellant flow rate. Differences between discharge voltages indicated by the curves 77, 78, 79 of FIG. 7, and the discharge voltages plotted in FIG. 8 are generally attributable to filament temperature for the cathode 48. Since the data was collected in different test runs, the discharge voltage may be slightly different depending on the filament temperature. The main point of the plots in FIGS. 7 and 8 is to show that the discharge voltage is not very sensitive to changes in discharge current. This is to say that the device can operate at a wide range of discharge currents with the discharge voltage varying only by a small amount. This operation is similar to hollow cathode plasma contactor clamping.

From FIGS. 7 and 8 it can be seen that:

a) The discharge current increases more rapidly than linear with increases in discharge voltage.

b) The discharge voltage tended to saturate at a reduced flow rate.

c) The discharge power ranged between about 20 and about 40 watts. (Note: cathode 48 heating current accounted for up to 10 W.)

Conclusion

The compact plasma accelerator 10 is a simple, compact and efficient source of low energy plasma or directed ion beams. The magnetic field 56 with an ionization gas source (plenum orifices 44) centered in a cusp 60 of the field 56, combined with an electric field gradient directed into the cusp 60, efficiently provide both ionization of the ionization gas and also acceleration of the resultant ions in a directed beam. A single power supply can be used to power the hot filament cathode 48 and to charge the plenum/anode 42. There is no grid. Inert gases can be used for the ionization gas, thereby providing a non-contaminating and non-toxic plume. Permanent magnets can be used that are simpler and lighter than commonly used electromagnets.

A major appeal of the present invention is its simplicity. The compact plasma accelerator 10 provides a means to generate ions within very small dimensions, and can be used as an ion source for propulsion applications (as a thruster), or for plasma processing duty. In the case of the propulsion application, the gridless nature of the device 10 gives it a potentially higher thrust density potential as compared with gridded sources of similar dimensions. The compact plasma accelerator 10 can also be used as a very compact plasma source that can be interfaced with other schemes such as the gridded micro-ion thruster. In this case, the compact plasma accelerator would provide the flowing plasma for a high voltage gridded stage that would accelerate the ions to higher velocities to increase the overall specific impulse of the device. The compact plasma accelerator 10 could also be used in plasma processing applications requiring low energy ion beams. Additionally, the compact plasma accelerator could be used as a source of low energy oxygen ions for spacecraft-LEO (Low Earth Orbit) environmental interactions. The discharge does not suffer from poisoning issues that plague hollow cathode based discharges.

Unique attributes of the present invention can be summarized as follows:

a) Extremely low volume, mass.

b) Operates at very high propellant utilization at very low flow rates.

c) Plume is non-contaminating.

d) Device can operate in principle on one power supply.

e) Capable of very low power operation (20–50 W) while developing modest thrust in the 1 mN range.

f) Can serve as a standalone system, or can be used to inject ions into a high perveance high voltage extractor.

g) Can be used as a low energy ion source for plasma processing.

h) Novel electron containment/utilization scheme allows for marked enhancement in electron utilization which is the key to a high ionization efficiency.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A compact plasma accelerator having components including a cathode electron source, an anode, an ionizing gas source, and a magnetic field source, wherein:

the components are held by an electrically insulating body having a central axis, a top axial end, and a bottom axial end;

the magnetic field source comprises: a cylindrical magnet having an axis of rotation at is the same as the axis of rotation of the insulating body, and magnetized with opposite poles at its two axial ends; and an annular magnet coaxially surrounding the cylindrical magnet, magnetized with opposite poles at its two axial ends such that a top axial end has a magnetic polarity that is opposite to the magnetic polarity of a top axial end of the cylindrical magnet;

the ionizing gas source is a tubular plenum that has been curved into a substantially annular shape, positioned above the top axial end of the annular magnet such that the plenum is centered in a ring-shaped cusp of a magnetic field generated by the magnetic field source, and having one or more capillary-like orifices spaced around the top of the plenum such that an ionizing gas supplied through the plenum is sprayed through the one or more orifices;

the plenum is electrically conductive and is positively charged relative to the cathode electron source such that the plenum functions as the anode; and the cathode electron source is positioned above and radially outward relative to the plenum.

2. A compact plasma accelerator according to claim 1, characterized in that:

the cylindrical magnet and the annular magnet are permanent magnets.

3. A compact plasma accelerator according to claim 1, characterized in that:

the plenum is enclosed in an electrically insulating material having an axially-oriented hole above each of the one or more orifices.

4. A compact plasma accelerator according to claim 3, further characterized in that:

the body has a cavity opening upward and sized to enclose the plenum in combination with an electrically insulating cover plate that covers the cavity and the plenum; and the cover plate has the axially-oriented holes.

5. A compact plasma accelerator according to claim 1, characterized in that:

a field shaping plug is mounted in the insulating body above the cylindrical magnet such that the field shaping plug's axis of rotation is the same as the axis of rotation of the cylindrical magnet; and the field shaping plug is a cylinder that comes to a conical point at its top axial end, and is made of a ferromagnetic material; such that:

the field shaping plug concentrates the magnetic field emerging from the top axial end of the cylindrical magnet to form a very narrow pointed cusp above the field shaping plug.

6. A compact plasma accelerator according to claim 5, further characterized in that:

the field shaping plug is made of mild steel.

7. A compact plasma accelerator according to claim 1, characterized in that:

the bottom axial end of the insulating body is covered by a backing plate made of a ferromagnetic material such that the backing plate concentrates the magnetic field at the bottom axial end of the cylindrical magnet and the annular magnet.

8. A compact plasma accelerator according to claim 7, further characterized in that:

the backing plate is made of mild steel.

9. A compact plasma accelerator according to claim 1, characterized in that:

the cathode electron source is a hot filament.

10. A compact plasma accelerator according to claim 9, further characterized in that:

the hot filament cathode electron source comprises one or more wires shaped in a ring that circumnavigates the plenum above and radially outward relative to the plenum.

11. A compact plasma accelerator according to claim 9, further characterized in that:

one or more power sources power the hot filament cathode electron source and the positively charged, anodic, plenum.

12. A compact plasma accelerator according to claim 1, characterized in that:

the cathode electron source is selected from the group including one or more hollow cathodes and a field emitter type cathode.

13. A compact plasma accelerator according to claim 1, characterized in that:

the electrically insulating body is made using a ceramic material.

14. A compact plasma accelerator according to claim 13, further characterized in that:

the ceramic material is a machinable ceramic.

* * * * *